United States Patent [19]

Papas

[11] 4,268,933

[45] May 26, 1981

[54] BRISTLES FOR AN INTERPROXIMAL AND PERIODONTAL TOOTHBRUSH

[76] Inventor: Sophia Papas, 49 Mellow La., Jericho, N.Y. 11753

[21] Appl. No.: 98,859

[22] Filed: Nov. 30, 1979

[51] Int. Cl.[3] ..... A46B 9/04

[52] U.S. Cl. ..... 15/167 R; 15/110

[58] Field of Search ..... 15/167 R, 167 A, 106, 15/110; 128/62 A

[56] References Cited

U.S. PATENT DOCUMENTS

| | | | |
|---|---|---|---|
| 958,371 | 5/1910 | Danek | 15/167 R |
| 1,382,681 | 6/1921 | Segal | 15/167 R |
| 1,657,450 | 1/1928 | Barnes | 15/167 R |
| 1,929,530 | 10/1933 | Abelson | 15/167 R |
| 1,943,225 | 1/1934 | McIntyre | 15/167 R |
| 1,981,657 | 11/1934 | Miller | 15/167 R |
| 2,041,262 | 5/1936 | Ness | 128/62 A |
| 2,154,352 | 4/1939 | Peterson | 15/167 A |
| 3,934,298 | 1/1976 | Kim | 15/167 A |

FOREIGN PATENT DOCUMENTS

| | | | |
|---|---|---|---|
| 1532809 | 4/1970 | Fed. Rep. of Germany | 15/167 R |
| 356013 | 9/1931 | United Kingdom | 15/167 R |

*Primary Examiner*—Peter Feldman

*Attorney, Agent, or Firm*—Burton S. Heiko

[57] ABSTRACT

Bristles for a toothbrush arranged in repeating patterns of like and unlike shaped bristles, consisting of clusters of long, soft, bristles alternating with clusters of shorter, pyramidal shaped bristles which shorter bristles begin at the base of the longer clusters of bristles, together with the other two sides of the pyramid facing the width of the brush, all four sides gradually moving in a convex curve to the apex of the pyramidal bristles which is centered from all sides, allowing the bristles to be used along any portion of the teeth, either occlusal, or labial, lingual or buccal either in a horizontal motion along the teeth or in a vertical direction either up or down, which brushing facilitates not only the cleaning of the teeth and between the teeth, but also the massaging and strengthening the gingerval tissue providing both interproximal and periodontal bristles used at the same time.

3 Claims, 7 Drawing Figures

9040 — IR — CD

BRISTLES FOR AN INTERPROXIMAL AND PERIODONTAL TOOTHBRUSH

BACKGROUND OF THE INVENTION a. Field of the Invention

This invention is concerned with the bristles of a toothbrush and more particularly with the grouping of the bristles on the same toothbrush so that the brush can be used both as an interproximal and periodontal toothbrush. In applicant's prior application, Ser. No. 865,175, filed Dec. 28, 1977, now Pat. No. 4,185,349 only the shape of the brush and handle was disclosed. The present invention concerns the arrangement of the bristles as they would appear on a brush for the dual purpose of both cleaning and massaging the soft tissue next to the teeth. Studies show that as people get older the principal problem becomes not tooth decay but soft tissue deterioration about the gums leading to loss of teeth and other problems of that nature. In many cases as the gingiva starts to recede the gums become tender, with bleeding, shrinking and shriveling away from the teeth, causing the attachment process to become exposed and weakened, leading to eventual loss of teeth.

For many years proper treatment of the gums and attachment processes was never thought of since most concern was that of losing teeth due to caries. As the population was primarily young and good dental care comparatively new, little thought was given to that part of the population that was experiencing different problems with their teeth. But, recently, as the population started to age, and dental care became possible for more people, and, as more people kept their teeth into later middle and old ages, awareness reached both the profession and people generally, that much can be done to prevent people from losing their teeth at a later age due to gum disorders. This movement has been slow in coming and treatment and awareness was more narrowly restricted than at present. Recent events indicate that treatment has still been geared for the younger person, with processes such as flouridation, and that a definite need has arisen for a more useful toothbrush that can not only clean the teeth but also keep the older person's gums healthy. Most people realize today that cosmetically, nutritionally and functionally, natural teeth are far superior to dentures.

b. Description of the Prior Art

There have been many attempts to improve the bristles on a toothbrush over the past years. But this was mostly for the better brushing of the teeth with little thought concerning the soft tissue surrounding the teeth. There was scant concern for the abrading and irritating of the gums and other soft tissues. Many of the patents in this area are of foreign origin. In Great Britain Pat. No. 19408, an early patent, a wedge is formed separately from the main group of bristles which wedge was meant to clean between the teeth.

In Swiss Pat. No. 383322, the bristles form a dense mass at the top of the bristles for the purpose of brushing and cleaning the teeth.

In Great Britain Pat. No. 471,387, the bristles are set shorter toward the far end of the brush to help clean the crowns, with the tips of the bristles forming a corrugated pattern, and, with different sets of bristles for different purposes of teeth cleaning.

In Great Britain Pat. No. 385,238, the bristles are arranged in a curved manner so that the arc of the ends or tops of the bristles conform to the shape of the teeth in the jaws. In addition, the bristle knots can increase in length towards the ends of the brush facilitating the brushing of the rear molars.

In French Pat. No. 1,333,158, the improvement lies in the continually curved end surfaces of the bristles imparting the full force of the brushing to cleaning the crowns of the teeth.

In German Pat. No. 920,904, a two headed toothbrush is used with each head being of different shape and the bristles arranged on one head across the head and on the other head with the bristles arranged in a longitudinal direction.

In U.S. Pat. No. 1,382,681, there is a crenelated effect with the larger group of bristles used to brush the teeth and the shorter groups of bristles, made from stiffer material, used for scraping and to support the longer but weaker bristles.

In U.S. Pat. No. 2,845,649, there is a large number of thin bristles set in large tufts, with each tuft close together, with the length of each bristle on each tuft the same height.

In all of these bristles the invention does not concern itself with the soft tissues in the mouth and surrounding the teeth. There exists a need, unfulfilled as yet, for bristles able to clean between the teeth as well as massage and care for the gums to prevent bleeding as well as encouraging the health of the gums to continue their support of and binding to the teeth.

SUMMARY OF THE INVENTION

Apparatus consisting of bristles on a toothbrush arranged in repeating fashion with groupings of longer bristles alternating with groups of shorter bristles, and with the shorter bristles forming a convex pyramid-like group with all four (4) sides of the pyramid-like clump being equal, with the two sides next the longer bristles rising from the base adjacent to the longer bristles together with the other two sides facing the width of the brush, all sides gradually rising in a convex-like curve to the common apex of the pyramid which height is about half the height of the longer bristles, forming a pyramidal-like cluster between the clusters of longer bristles, with the common apex of the pyramid centered from all four (4) sides, allowing both sets of bristles to be used along any portion of the teeth, either occlusal, or labial, lingual or buccal, either in a horizontal direction along the jaw or in a vertical direction, either up or down, which brushing facilitates not only the cleaning of and between the teeth, but also the massaging and strengthening of the gingival tissue surrounding the teeth and providing both interproximal and periodontal bristles on the same brush to be used at the same time.

Further brushing with these bristles on either the occlusal, labial, lingual or buccal surfaces of the crowns with the present invention promotes a caterpillar effect that prevents the bridging effect of other bristle type brushes and allows the bristles to reach interproximally between the teeth on the occlusal surfaces and on the other surfaces of the crowns and not only promotes the cleaning of the spaces between the teeth but because of the pyramidal clusters of bristles also promotes the good health of the periodontal tissues. Brushing with these bristles either horizontally along the row of teeth or vertically, either up or down, enables the long bristles to act interproximally while the four sides of the pyramidal bristles make a fit with the gingival border along the teeth at the base of the crowns and with the interdental papillae facilitating both the cleaning of these tissues and promoting their healthy growth.

In the best mode, both types of bristles alternate to form an interproximal and periodontal type brush. But these bristles could be used separately from each other to form either an interproximal or periodontal type brush. Nor would it only be necessary to alternate these types of bristles but various combinations and patterns could be staggered and variously alternated on brushes and even more individualized brushes made to accommodate the varying mouths and dental formations of persons suffering from different types of injury, disease and anomalies.

It is the principal purpose of this invention to provide at one and the same time both an interproximal and a periodontal type of bristle on one brush.

Another purpose of this invention is to provide bristles that can be used either interproximally or periodontally.

Another purpose of this invention is to provide specialized bristles on a brush that can be individualized for the purpose of treating differing mouth and dental conditions.

DETAILED DESCRIPTION OF THE DRAWINGS

While the invention will be described in connection with the preferred embodiments, it will be understood that it is not intended to limit the invention to these embodiments. On the contrary, it is intended to cover all alternatives, modifications and equivalents as may be included within the spirit and scope of the invention as defined by the appended claims.

The invention is designed to provide the necessary brushing, cleaning and massaging action for the teeth and gums without damage to the gums and the other soft tissue surrounding the teeth. For too long in the past the brushing of and cleaning between the teeth was done at the expense of abrading and injuring the soft tissue. Cleaning the teeth cannot be at the expense of injuring the gums. The blunderbuss actions of brush and bristles can no longer be tolerated, and, brushing the teeth should not be a masochistic experience for the user. Both the public and the profession are now becoming aware of this need, and, the individual problems of the users.

Figure 1A:
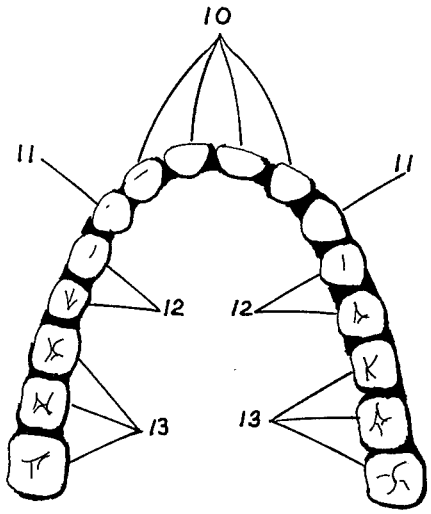
FIGS. 1*a* and 1*b* are top plan views of a full set of teeth in the normal, adult, arranged in the maxillary and mandibular jaws respectively.
Figure 1B:
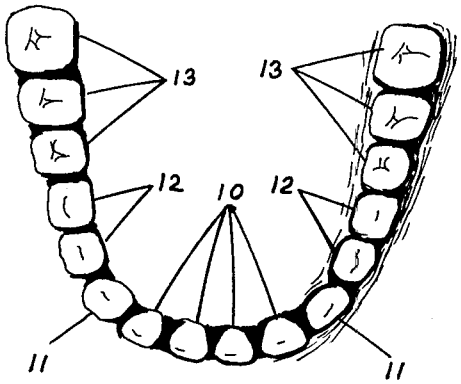
Figure 2A:
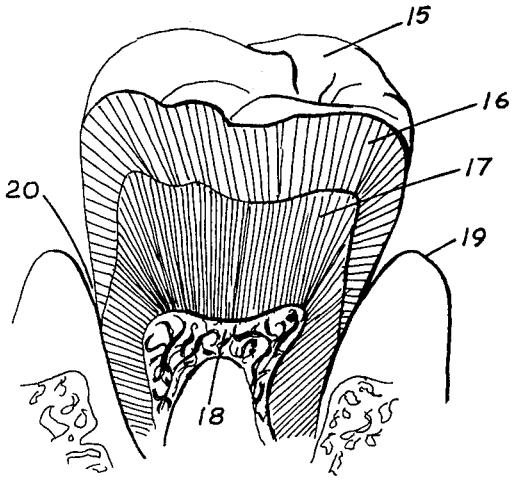
FIG. 2*a* is a side view of a tooth showing its various parts and its relation to the gums.
Figure 2B:
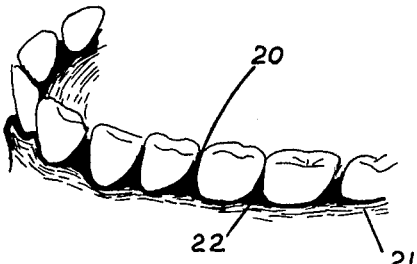
FIG. 2*b* is a side view of a part of the lower jaw showing the relationship of parts of the gingiva to the teeth.

In FIGS. 1*a* and 1*b* the teeth are arranged as shown in the upper and lower jaws. All told in an adult there is a total of 32 teeth, arranged 16 to the upper jaw and 16 to the lower or mandibular jaw. The upper jaw is fixed to the skull and only the lower jaw is movable. Both upper and lower jaws have exactly the same types of teeth placed oppositely each other. There are four different types of teeth in the jaws: eight incisors 10, arranged in the exact center of both jaws, four to a jaw, thereafter two canines 11, 11 on each jaw, at opposite ends of the incisors, and then continuing inward into the mouth on both sides of the upper and lower jaws, eight bicuspids 12, 12, two on each side of the canines. Running thence posteriorly from the bicuspids are the molars 13, 13, three on each side of the jaws making in all a total of twelve.

In the case of primary teeth, the teeth of children, there is a total of 20 teeth, 10 on each jaw without any molars. There is the same number of incisors, canines and bicuspids but no molars, arranged in the same way as adult teeth. Generally, this applies to children under the age of six years.

The primary teeth are of uniformly less crown height and less diameter than the permanent teeth. But since irritation of the gingiva is of less importance than just brushing the teeth, in young children, toothbrushes and bristles are generally just scaled down from that of adult brushes with little difference.

Crown heights vary as to different teeth as well as the diameters of the teeth through the crown. The height of the crown above the gum line varies from a top of 11 mm in the case of canines to that of 7 mm in the case of the third molar, with the incisors, canines and bicuspids ranging in between. In the case of the diameter through the crowns measurements vary inversely from that at the gingiva to the top of the crowns with the diameter through the molars varying from 11 mm to around 7.5 mm in the incisors, with, the other types of teeth ranging in between. Of course, these are approximations and variations may occur higher or lower than the figures given.

It will be seen that in order for the bristles to cover the entire crown of the permanent teeth they will have to be of sufficient length to reach the entire crown. But, if there is some periodontal disease then the gums will shrink away from the teeth exposing not only the crowns made up of enamel but also the underlying softer layer called dentin. At the same time the bristles will have to be of sufficient size to penetrate in between the teeth for cleaning. This is true not only for adults but also for children. In the case of adults teeth can be missing and cause a movement that increases the spaces between the teeth. In the case of children losing the primary teeth and gaining the permanent teeth causes gaps between the teeth inasmuch as it is a slow process and the permanent teeth are usually larger.

The tooth itself consists of an outside layer of enamel, 16, down to the gum line, 19, an inner layer of dentin, 17; surrounding a much softer pulp, 18, in which is located the nerve and blood supply. The enamel once laid down cannot be added to while the dentin can have additional layers added to it for further protection.

But the most serious problem today, especially in older persons, comes from disease and deterioration of the periodontium, the soft tissues surrounding the teeth. The periodontium consists of those layers of soft tissue which invest and support the teeth. The periodontium is divided into the free gingiva, 19, the attached gingiva, 22, and the alveolar mucosa, which surrounds the teeth on all sides; and, the attachment apparatus, consisting of the cementum, the periodontal ligaments, and the alveolar process. The last three actually anchor the teeth into the jaw and is covered by the gingiva and hold the teeth firm by various fibers. The gingiva consists of a free and attached gingiva. The free gingiva consists of the interdental papillae, 20, the free gingival groove, 21, and the free gingiva down the gums to the alveolar mucosa, 22. The free gingiva is made up of those tissues over the attached gingiva and this loose or free part of the gum or gingiva surrounding the teeth forms a small pocket between the gum, 19, and the enamel part of the tooth, 16, called the sulcus. Since the enamel stops at the free gingival border, a deeper pocket causes the underlying dentin layer, 17, to become exposed. The free and attached gingiva consists of a special tissue called masticatory mucosa and is of a lighter color than just lining mucosa which is that tissue that covers the rest of the mouth except for the gingiva which is only around the teeth. The lining mucosa which is everything other than the gingiva is of a bright red color, a smooth surface, movable, elastic, non-keratinized, and thin with both elastic and collagenous fibers therein. Whereas the gingiva is of a lighter color, stippled like an orange, keratinized, and thick with collagenous fibers only. The gingiva is meant to take pressure and contact, and, is meant to be exercised. Present treatment indicates that while brushing the teeth the gingiva should be massaged and exercised to keep the gingival structure intact. If it is not kept intact, then, as the free gingiva falls away, the attached gingiva becomes exposed with the attachment apparatus weakening, and, finally when it gives way the tooth is lost. Much of periodontal treatment can be painful and depends to a great extent on the restoration and good health of the free and attached gingiva.

This invention is designed to help that treatment by providing generalized forms of bristles that aid in keeping the interdental spaces of the teeth free of debris and keeping the free gingiva clean including the sulcus, while stimulating the gingiva by gently exercising and massaging this soft tissue, and, cleaning the crowns of the teeth.

Figure 3:
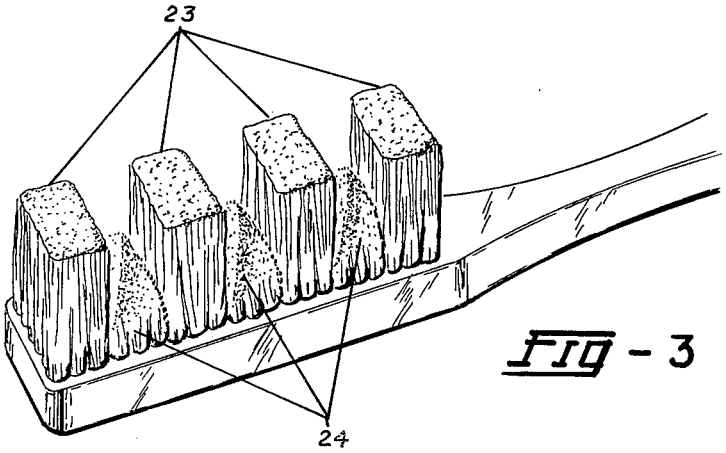
FIG. 3 is an isometric view of the bristles showing how the longer bristles are arranged with the pyramidal bristles.
Figure 3A:
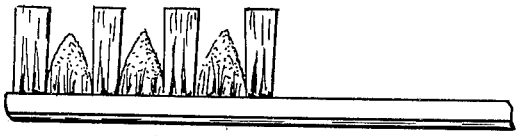
FIG. 3*a* is a side view of the bristles in FIG. 3.
Figure 3B:
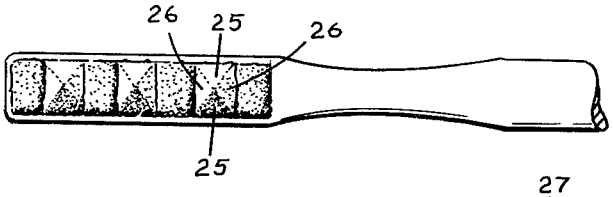
FIG. 3*b* is a top plan view of the same bristles.

FIG. 3 shows the invention from an isometric view. The cluster of long bristles, 23 is interspersed between clusters of the pyramidal type bristles, 24. Reference numerals 25 and 26 show the four sides of the pyramidal bristles as shown in a top plan view in FIG. 3*b*. The bristles start at the base of the longer clusters of bristles and rise slowly, convexly, continuing to the apex of the pyramidal cluster, built up from all four sides, and going to the apex being made up of longer and longer bristles until they meet at the apex in the center of the pyramidal clusters, 24. The pyramidal bristles start with bristles of at least 4 mm and end up at the apex which is around half the size of the longer bristles. Each side or face of the pyramidal clusters is like the others with all sides rising in height culminating at the apex of the cluster. Unlike most bristles in the ordinary brush, all parts of the bristles in the pyramidal clusters can be used according to this invention and it doesn't matter whether the brush is moved horizontally along the row of teeth or vertically, either up or down, depending on whether one is brushing teeth in the upper or lower jaw. Present dental practice does not believe in brushing horizontally along the row of teeth for any appreciable length or covering more than two teeth. But, initially, for the first or second tooth in a row there is a limited horizontal motion for the purpose of brushing the labial, lingual or buccal part of the crown. It is here where the pyramidal clusters make a good fit with the gingiva, first in the horizontal direction, and, then, in the vertical direction, either up or down. At these times the various parts of the pyramidal cluster come into contact with the gingiva and act to massage and firm up the gingiva in the direction toward the occlusal part of the crown and not down and away toward the roots of the tooth.

Figure 4:
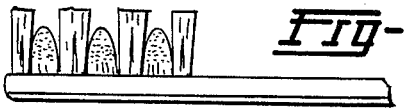
FIG. 4 through FIG. 4*h* are drawings of different kinds of bristles on toothbrushes.
Figure 4A:
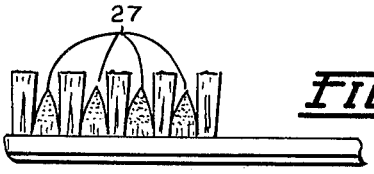
Figure 4B:
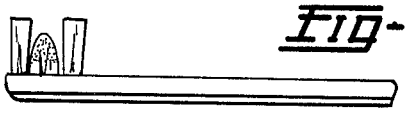
Figure 4C:
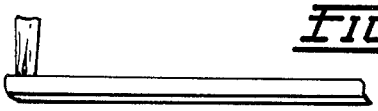
Figure 4D:
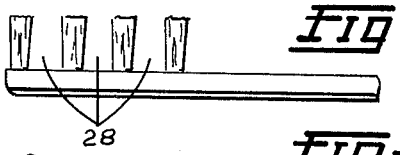
Figure 4E:
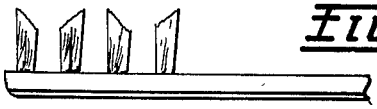
Figure 4F:
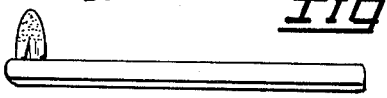
Figure 4G:
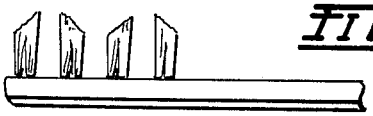
Figure 4H:
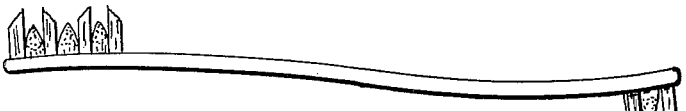

In FIGS. 4 through 4*h* alternate types of bristle arrangements are made with the spaces between the various groups either diminished, enlarged, staggered or removed altogether depending on the area of the jaw and teeth to be serviced. Several alternate forms present themselves as seen in these figures. Instead of alternate forms of long and pyramidal bristles being used, brushes can be made only of one type of bristles with spaces between these clusters. Or instead of a 1:1 ratio there could be groupings of 2:1 or even 3:1 in favor of either pyramidal or long clusters of bristles. Or just evenly or unevenly staggered clusters of long bristles could be used just for interproximal cleaning alone. Or only staggered clusters of pyramidal bristles used only for periodontal brushing only. And special bristles could be made just for brushing certain sections of the teeth and/or gums that have specific problems. There could even be special types of bristles made for irregularly spaced teeth corresponding to missing teeth in the jaw. Variations could be specially made so that users need not be unnecessarily exposed to unsuitable bristles on brushes that do more harm than good.

Variations in the heights of the pyramidal clusters could be made depending on the conditions sought to be alleviated. Instead of these clusters being only of half the height of the longer clumps of bristles they could be less or more, or three-quarters or one-quarter of the height. Moreover, the shape of the longer bristles could be changed to accentuate the interproximal nature of the longer bristles. Besides being of level shape, they could be slightly rounded or wedge shaped and various combinations could be inserted on different brushes.

Brushing across the teeth in a horizontal direction taking just as few teeth as possible at one time would engage the two opposite sides of the pyramidal clusters in the longitudinal direction, 26, and would effectively engage and fit the interdental papillae, 20, in both directions horizontally. The sides of the pyramidal clusters would only engage the interdental papillae for only half the sides depending on whether it was the upper or lower jaw being brushed. The smaller of the bristles toward the beginning of the horizontal sides of the pyramidal clusters would ensure a massaging effect and not an abrading effect as the shape of the pyramidal bristles will coincide with the shape of the interdental papillae. This is true whichever way the brush is held, on whatever side, and on either jaw. The fit of the bristles in the pyramidal clusters prevents damage to the gingiva while at the same time stroking and massaging the gingiva in the direction of the occlusal surface of the teeth.

Figure 6:
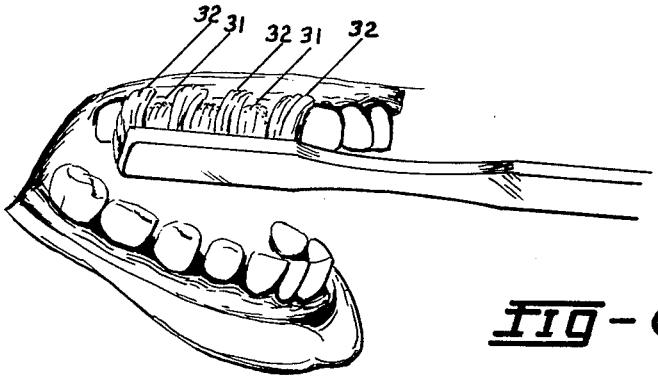
FIG. 6 is a side view of how the bristles would fit on the upper jaw.
Figure 7:
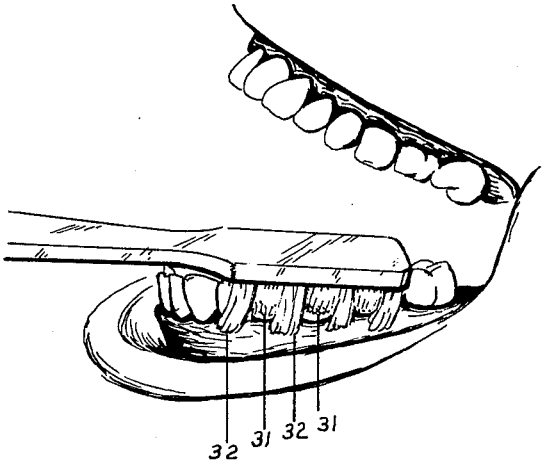
FIG. 7 is a side view of how the bristles would fit on the lower jaw.

In FIGS. 6 and 7 there are drawings of how the bristles would fit the free gingival border surrounding the face of the teeth taken from the sides of the upper and lower jaws. The free gingival border would be the same on the rear face, labial side, of the teeth as well. On the lower jaw, FIG. 7, such a border would be U-shaped with the interdental papillae forming the arms of the U. While on the upper or maxillary jaw, FIG. 6, the border would be an inverted U-Shape with the arms of the U formed by the interdental papillae. The brush would normally fit so that its larger bristles are at an interproximal position while its pyramidal sides would fit the free gingival border and proper direction would be to stroke downward on the upper jaw and stroke upward on the lower jaw.

This brushing would move the free gingival tissue to its correct place around the tooth while it was stretched and massaged in the right direction. At the same time it would tend to force up and out of the sulcus any particles of food trapped there. Use of other devices have created all sorts of pockets of food deep within the gingival border enlarging the sulcus and have in some instances created problems in their use.

Tooth sizes are greatly variable from the labial to the buccal (front to rear of the mouth), in the height of the crown, (from gingiva to the occlusal surface), in width of the teeth themselves measured from the side or through the crown at its widest, and in width of the spaces between the teeth. Under these circumstances bristle structures must fit on, around and in the varied dimensions. In many sense the bristle structure must be a compromise between all of these. It might be possible to produce bristles on brushes that could only brush the incisors and canines, or just the bicuspids, or only the molars. But special toothbrushes for specialized sections of teeth would be too much of an undertaking for most people to use to say nothing of its expense. Nor is it necessary in most cases, although special circumstances could require specialized bristles and brushes. But for most a generalized set of bristles fitting most people would be more than adequate. The average width of teeth as well as the average height of the crowns together with the average space between teeth can be estimated, although the average space between teeth varies much more widely than the other factors. But, the design of these bristles makes such factors less crucial. The contours of the gingiva are of the same shape however the size of the tooth it surrounds and the pyramidal bristles fits the general gingival shape surrounding the teeth. The larger clusters of bristles could then find openings in the spaces between the teeth or simply flatten against the crowns of the teeth without harm to the gingiva. In any event since the longer bristles are made from material as soft as the pyramidal bristles no harm can come to the gums and can only reinforce the general massaging effect on the gums.

Figure 5:
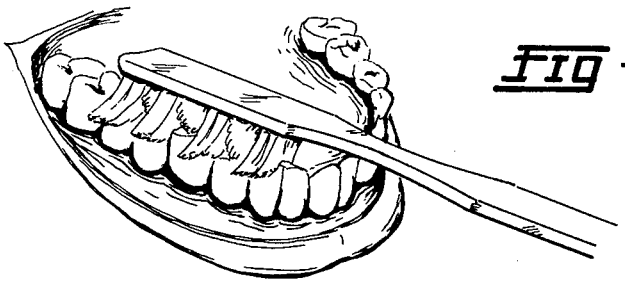
FIG. 5 is a drawing of how the bristles would fit on the occlusal surface of the lower jaw.

The average long bristles would have to be around 11 mm long as any shorter size would not ensure the full and complete brushing of the crowns whether on the occlusal, lingual, labial or buccal sides of the crowns. But in any event the bristles of the longer clusters need not be larger than the average dimensions of the crowns of the teeth. But, in brushing the crowns, either on the occlusal surface or on the other sides, an unexpected result is achieved by using both types of bristles on the same brush. The bristles on the usual brush being of the same or similar height tend to bridge the teeth so that much of each tooth is not fully brushed. Especially in the cusps on the occlusal surfaces of the teeth, the usual bristles tend to bridge over much of the spaces in the cusps preventing effective brushing. But in the present invention, FIG. 5, the arrangement of the bristles tends to allow a falling into the spaces like the cusps or between the teeth, a sort of collapsing into the spaces, like a caterpiller effect, that tends to carry the longer bristles deeper into such cusps or spaces between the teeth. In the event the longer clusters of bristles penetrate into the spaces between the teeth, 29, the pyramidal bristles tend to move as deeply as they can into the cusps, 30. But in any event the shorter bristles do not prevent the longer bristles from moving into any spaces they can find. The longer bristles would tend to find such spaces while the shorter bristles would not hamper such effect since its shape and size negates any bridging effect between or on the teeth. On the sides of the teeth both groups of pyramidal and long bristles would tend to do their periodontal and interproximal work without hindrance or ill effect. This collapsing into spaces would be at least the minimum difference between the long and shorter bristles and would support better brushing on the crown and better massaging to the gums. Proper brushing as now prescribed could now be more easily followed since the fit is better. And in the case of the gingiva there would be no tendency to scratch or abrade the gingiva since in all directions the pyramidal bristles would tend to a better fit between the face used and the free gingiva.

The superiority of this invention lies in the localization of tooth brushing with gum massage which enables the brush with different types of bristles to do its separate jobs at the same time. While at the same time one type of bristle does not hinder the other from doing its job. Also the present invention allows for far more variation in use than any other bristle form or combination used heretofore. It combines in one bristle arrangement both an interproximal and a periodontal bristle capable of doing separate jobs at the same time. The variability and usability of the bristles lies virtually along its entire length and breadth. This range of shape accommodates a great range of purposes and allows for all sorts of combination. And, both types of bristles would be made from the same material.

The bristles need not be set too low for the pyramidal type of bristles and as previously mentioned should start at around 4 mm from the base to make sure there is no contact between the handle and the gums. But, this, too, can be varied depending on what sort of handle is used with the bristles. And the pyramidal type bristle could be made more convex or even more concave under certain circumstances.

Bristles can be made for the primary teeth by scaling down the sizes of the adult bristles to make an average fit for the primary teeth in exactly the same way as they fit for adults. But since the gums do not present a problem at this age, the pyramidal bristles can be scaled up to give more effect to cleaning the crowns rather than exercising the gingiva. Although exercise of the gingiva even at this age is important, too. Since molars are not usually present before six years of age, the bristles could be made shorter. The average crown size of the primary teeth being around six 6 mm while the diameter through the crowns varies greatly from front to back, bristle sizes could simply be varied in proportion to that of adults. There could be bristles made to accommodate the changes taking place during the pre-teen and teen years, too. Naturally, all sorts of conditions present themselves and all sorts of specialized bristles could be made depending on age and circumstances. Where teeth are growing and where teeth are missing, the pyramidal bristles would help to make a better fit to better brush the teeth that are there and those that are coming in.

And finally, with the present invention more individualized bristles could be made to cope with different dental conditions. No longer does the user have to brutalize his or her mouth to cope with one condition while aggravating another.

While the invention has been described in conjunction with specific embodiments, there are many alternatives, modifications and variations that will be apparent to those skilled in the art in light of the foregoing description. Accordingly, it is intended to embrace all such alternatives, modifications and variations as fall within the spirit and broad scope of the appended claims. It is also intended to include all equivalents and substitutes.

I claim:

1. In a toothbrush having bristles attached to the end of a rigid frame for the purpose of inserting the bristles into the mouth to brush the teeth, wherein the improvement comprises:

(a) groups of long, soft, bristles alternating with groups of shorter, soft, bristles from which shorter bristles are shaped four (4) sloping sides rising together to form the apex of a pyramidal shaped group, and (b) which group of pyramidal shaped, soft bristles, begin at the perimeter of the base of the pyramid, on the frame, with bristles rising, convexly, from the perimeter of the four sides to a common apex shorter in height than the bristles of the longer clump, with two of the four sides perpendicular to the long axis of the frame and the other two sides, opposite each other, parallel to the long axis of the frame, and (c) with the spacing of the alternating clumps of different sized bristles closely approximating the average width of the teeth with the longer bristles fitting into and between the spaces between the teeth, and the shorter pyramidal bristles fitting reversely into the gingival border around the base of the crowns of the teeth, and (d) allowing the bristles to both clean the crowns and the spaces between the teeth while at the same time massaging and exercising the gingiva bordering the teeth.

2. The claim as recited in claim 1 wherein the height of the longer bristles are at least 11 mm long and the height of the shorter bristles are begun at a height of at least 4 mm.

3. The claim as recited in claim 1 where the height of the shorter bristles are not more than one-half the height of the longer bristles measured at the apex.

* * * * *